United States Patent [19]

Bellows

[11] 4,192,372

[45] Mar. 11, 1980

[54] ADJUSTABLE LEVER FOR FIRE DETECTION SYSTEM

[75] Inventor: Kenneth O. Bellows, Wellsville, N.Y.

[73] Assignee: The Air Preheater Company, Inc., Wellsville, N.Y.

[21] Appl. No.: 930,461

[22] Filed: Aug. 3, 1978

[51] Int. Cl.[2] ..... F28D 19/00; F28G 15/00

[52] U.S. Cl. ..... 165/5; 165/11; 74/98; 74/400; 74/522; 250/342

[58] Field of Search ..... 165/5, 11; 250/342; 74/522, 98, 400

[56] References Cited

U.S. PATENT DOCUMENTS

| | | | |
|---|---|---|---|
| 757,217 | 4/1904 | Newton | 74/522 |
| 971,764 | 10/1910 | Lutz | 74/522 |
| 2,922,317 | 1/1960 | House | 74/522 |
| 4,022,270 | 5/1977 | Stockman | 165/5 |

*Primary Examiner*—Albert W. Davis, Jr.
*Attorney, Agent, or Firm*—Wayne H. Lang

[57] ABSTRACT

A fire detection system for rotary regenerative heat exchange apparatus having multiple detectors, each detector being mounted independently on an arcuately reciprocable scanning arm. The several arms are laterally adjustable by a system of opposed screws in an articulated yoke to permit the selective positioning of each arm independent from the other scanning arms of the system.

5 Claims, 4 Drawing Figures

ADJUSTABLE LEVER FOR FIRE DETECTION SYSTEM

BACKGROUND OF THE INVENTION

1. Field of the Invention.

In regenerative heat exchange apparatus, a mass of heat absorbent material commonly comprised of packed element plates that form a heat absorbent matrix is positioned in a hot gas passageway to absorb heat from hot gases passing therethrough. After the plates become heated by the hot gas they are moved into a passageway for cool air where the heated plates transfer their absorbed heat to the cool air flowing therethrough.

As the hot exhaust gases are directed through the heat exchange apparatus, fly ash and unburned products of combustion carried by the exhaust gases are deposited on the surface of the packed element plates, and such deposits continue to be deposited and build up until air and gas flow through the heat exchanger are greatly retarded, if not substantially stopped. Heat is then generated in the deposits and the adjoining element to form a "hot spot" that, if not detected, will rapidly increase until the adjoining metal of the heat exchanger will itself ignite and cause a catastrophic fire.

2. Description of the Prior Art.

Recent developments in the use of infra-red ray detection apparatus to detect "hot spots" in a heat absorbent matrix of an air preheater in the manner disclosed by U.S. Pat. No. 3,861,458 of 1975 and U.S. Pat. No. 3,730,259 of 1973 have been extremely successful in carrying out their stated objective of signaling a potential "hot spot" or incipient fire well in advance of the occurrence of an actual damaging fire.

A subsequent U.S. Pat. No. 4,022,270 of 1977 was granted to define a series of detector "heads" that were moved in unison on independent lever arms to a position where they might "view" the potential "hot spots" and provide a signal that could be monitored by an operator. The detector heads were adapted to simultaneously move on arcuately movable arms to scan the heat absorbent matrix and then move back to an air lock where they could readily be cleaned or repaired for subsequent operation.

Frequently, however, lever arms supporting the detector heads would be slightly deformed or even radically bent so that they would fail to completely seat on the air lock while others would make a satisfactory seat in the manner originally proposed. Thus fly ash and unburned combustion products would continuously collect in some of the air locks not properly sealed, while further opening of an air lock door would create a flow passageway through the air lock permitting pressurized fluid from inside the heat exchanger to flow to the atmosphere.

SUMMARY OF THE INVENTION

This invention therefore relates to an arrangement for adjusting each radially swinging fire detector head independently and the chief objective is to provide an arrangement for adjusting each fire detection head independently of all other elements of the system by the use of an articulated lever arm having an adjusting means integral therewith.

DESCRIPTION OF THE PREFERRED EMBODIMENT

Figure 1:
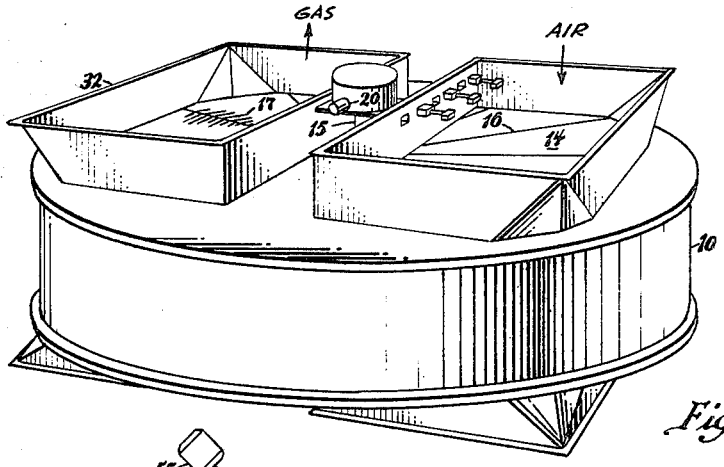
FIG. 1 is a perspective view of a rotary regenerative heat exchanger that includes the apparatus of the invention.
Figure 2:
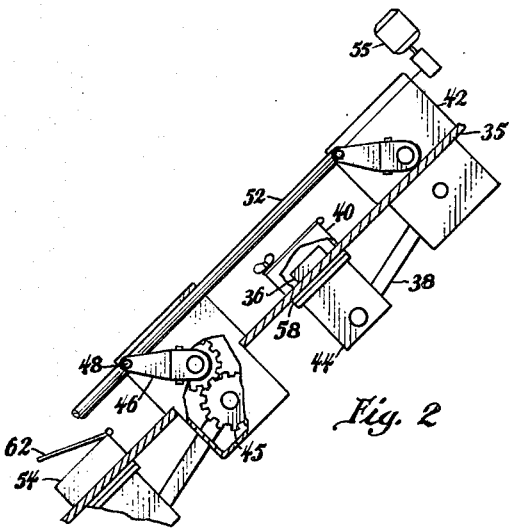
FIG. 2 is an enlarged top plan of an assembly of infrared ray detectors.
Figure 3:
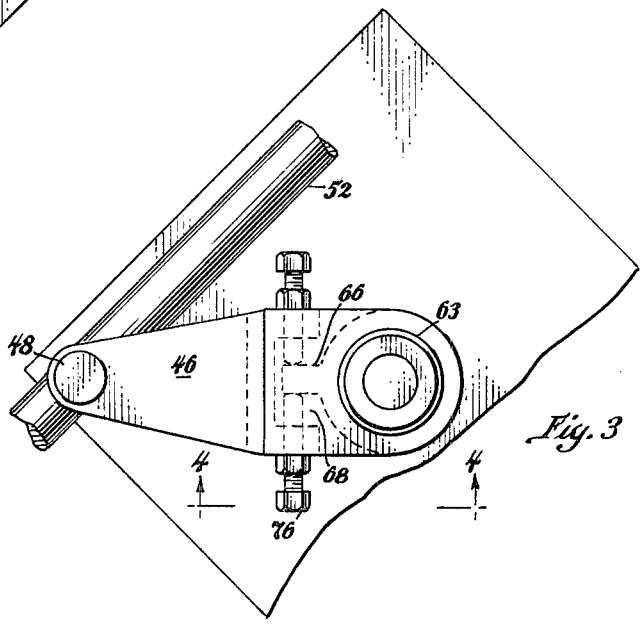
FIG. 3 is an enlarged top plan view showing a specific adjusting means.
Figure 4:
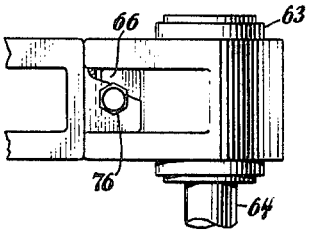
FIG. 4 is an enlarged cross-section of an adjustable lever arm as seen from line 4—4 of FIG. 3.

In the drawing a rotary regenerative air preheater comprises a cylindrical housing 10 that encloses a rotor having a casing 14 divided into a series of sectorial compartments by radial partitions 16 that extend between the casing 14 and a central rotor post 15. The compartments each contain a mass of heat absorbent material 17 in the form of corrugated plates or the like that provide passageways for the flow of fluid between opposite ends thereof. The rotor is rotated slowly about its axis by a motor 20 that advances the heat absorbent element contained by the rotor compartments and positions it alternately between the heating fluid and the fluid to be heated so that the heat absorbent material may absorb heat from the heating fluid and give it up to the fluid to be heated. After passing over the heated material and absorbing heat therefrom, the heated fluid is discharged through duct 32 to a boiler furnace or other place of use.

During start-up of a boiler furnace or other apparatus from which a heat exchanger receives a flow of hot exhaust gases, incomplete combustion of fuel in the burners thereof may cause particles of unburned fuel and products of combustion to become entrained in gases exhausting therefrom so that they tend to be deposited upon the heat absorbent matrix of the heat exchanger. These deposits accumulate rapidly and in a short time partially or even completely block the flow of the heating fluid and the fluid to be heated. Inasmuch as these surfaces are not then subjected to a cooling air flow, they continue to increase in temperature until a temperature of 700° F. to 750° F. is achieved. At this point the process becomes self-sustaining and heat is generated within the deposits until an active fire occurs, often with disastrous results.

Detectors that monitor apparatus of the type defined have been developed in accordance with U.S. Pat. No. 4,022,270. In this patent a series of detector heads 36 responsive to infra-red rays is positioned at the end of lever arms 38. The lever arms are themselves pivotally mounted in a gear box 42 at the side of rotor housing such that they swing in unison and together face the rotor and then, as the rotor rotates, the arms 38 swing back until the detector heads seat on the enclosure 40.

The detector heads on lever arms 38 are pivotally moved by gears 45 in box 42 mounted on the side of the rotor housing. An actuating arm or lever 46 extends back from each gear box and is pivotally attached at 48 to a reciprocating linkage 52, the reciprocating linkage being moved forward and backward by any suitable prime mover 55. As the linkage 52 is moved, the lever 46 rotates the gears 45 in gear box 42 and the lever arm 38 is moved arcuately outward to expose each detector head 36 to the potential emission of infra-red rays, but when the lever arms 46 are moved oppositely they move to a position where they seat upon the enclosure 40. Each enclosure has a removable door 62 as the outer wall thereof adapted to cover the opening 54 in the housing wall 35, while a sealing ring 58 around the opening in the enclosure precludes the flow of fluid when the detector head seats tightly thereto.

When a detector is exposed to the heating fluid, it is simultaneously subjected to contaminants carried by such fluid so that it becomes clouded, its sensitivity is reduced, and it must be cleaned to maintain its efficiency. When cleaning a detector head 36 becomes necessary, the heads are all swung toward the housing wall until they each seat over the respective opening of an aligned enclosure 40. Due to variations in structure, temperature, or operating conditions, all detector heads will not seat simultaneously, so while the seating of one head on enclosure 40 may prevent contaminants from flowing out from one enclosure, a leakage path may exist at other air lock enclosures 40 and leakage into the enclosure will occur. Further removal of a door 62 covering an opening in the side of enclosure 40 will permit fluid and its contaminants to flow out of enclosure 40 and contaminate the ambient atmosphere.

According to this invention each lever arm 46 is provided with a lateral adjusting means whereby the angle of throw of each lever may be varied to move the gears 45 in gear box 42 and lever arm 38 whereby each head 44 enclosing detectors 36 may be made to seat in a fluid-tight relationship over the opening in enclosure 40 to preclude fluid flow therethrough.

The adjusting means comprises a sleeve 63 keyed to shaft 64 and adapted to extend axially through one of gears 45. The sleeve has a projection 66 on one side thereof that extends loosely into a space 68 between spaced extensions 72 at an end of arm 46. In order that the projection 66 may be held tightly in space 68, each extension 74 is drilled and tapped to receive an adjusting screw 76. By loosening one screw 76 and tightening the opposed screw, the position of the projection 66 may be varied relative to the notch 68, and the gear train 45 rotated sufficiently to move the arm 38 and head 44 arcuately to obtain a perfect seating.

The shaft 64 from gear means 45 extends axially therefrom, through suitable sealing means in box 42 to preclude leakage between opposite sides thereof. Inasmuch as the lever 46 is completely outside housing 42, it is readily available for servicing or adjustment during normal operation. Should conditions be varied sufficient to effect an improper seating of a head 44 upon the enclosure 40, it is only necessry to adjust the particular screws 76 that control the "throw" of the particular lever being affected, and that head only will be moved arcuately forward or backward until proper seating is assured and a leak-free arrangement is maintained.

I claim:

1. Rotary regenerative heat exchange apparatus having a housing with inlet and outlet ports for a heating fluid and a fluid to be heated, a matrix of heat absorbent material carried in said housing, means for alternately subjecting said matrix to the heating fluid and to the fluid to be heated, a series of infra-red ray detecting heads arranged to view a portion of the matrix, a series of openings in said housing adapted to simultaneously receive each infra-red ray detecting head, a series of air locks each comprising an open ended enclosure having an open end thereof confronting each opening of the housing, a first lever arm carrying each detecting head, gear means pivoted upon said housing adapted to arcuately move each lever arm from a position within said housing where it faces the matrix of heat absorbent material to a position where it is seated upon an open end of the enclosure that comprises the air lock, a second lever operatively connected to said gear means, a prime mover for reciprocating the second lever, and means for varying the lateral movement of the second lever to permit each infra-red detecting head to simultaneously seat on an open side of said enclosure.

2. Apparatus as defined in claim 1 wherein the means for varying the lateral movement of the second lever comprises a laterally adjustable lever.

3. Apparatus as defined in claim 2 wherein the laterally adjustable lever includes a first part that is connected to said gear means and a second part that is pivotally connected to said prime mover with the lateral adjusting means therebetween.

4. Apparatus as defined in claim 3 wherein the lateral adjusting means comprises an arrangement of opposed set screws that connect first and second parts of the adjustable lever.

5. Apparatus as defined in claim 4 wherein the opposed set screws in the second part of the adjustable lever confront a radial projection from the first part thereof.

* * * * *